United States Patent [19]

Partington

[11] Patent Number: 4,813,850

[45] Date of Patent: Mar. 21, 1989

[54] INTEGRAL SIDE ENTRY CONTROL STAGE BLADE GROUP

[75] Inventor: Albert J. Partington, Winter Springs, Fla.

[73] Assignee: Westinghouse Electric Corp., Pittsburgh, Pa.

[21] Appl. No.: 178,724

[22] Filed: Apr. 6, 1988

[51] Int. Cl.[4] ..... F01D 5/30

[52] U.S. Cl. ..... 416/219 R; 416/193 A

[58] Field of Search ..... 416/219 R, 220 R, 193 A, 416/212 A, 241 B

[56] References Cited

U.S. PATENT DOCUMENTS

| | | | |
|---|---|---|---|
| 2,272,831 | 2/1942 | Chaluda | 416/219 R |
| 2,277,484 | 3/1942 | Flanders | 416/219 R |
| 2,429,215 | 10/1947 | Boestad | 416/219 R |
| 2,781,998 | 2/1957 | Barr | 416/220 R |
| 3,008,689 | 11/1961 | Morley et al. | 416/193 A |
| 3,014,695 | 12/1961 | Rankin et al. | 416/220 R |
| 4,130,379 | 12/1978 | Partington | 416/193 |

FOREIGN PATENT DOCUMENTS

| | | | |
|---|---|---|---|
| 25905 | 2/1977 | Japan | 416/212 A |
| 70253 | 6/1977 | Japan | 416/219 R |
| 26210 | 2/1982 | Japan | 416/212 A |
| 613667 | 12/1948 | United Kingdom | 416/212 A |

*Primary Examiner*—Everette A. Powell, Jr.

[57] ABSTRACT

A turbine blade having a bilaterally symmetrical side entry blade root for attaching the blade to a rotor of a steam turbine. The rotor has a longitudinal rotational axis of symmetry about which the blades rotate. The blades have a foil portion and a platform interposed between the foil portion and the blade roots. The roots are positionable in one of a plurality of complementary shaped grooves circumferentially disposed about the turbine rotor. The root is characterized by at least one pair of lugs symmetrically arranged on opposite sides of the root with each of the lugs having an outer bearing surface for reacting against a complementary opposed mating surface formed in each of the rotor grooves. The bearing surfaces on the lugs are aligned along an arc of a circle centered on the rotor rotational axis.

5 Claims, 4 Drawing Sheets

INTEGRAL SIDE ENTRY CONTROL STAGE BLADE GROUP

BACKGROUND OF THE INVENTION

The present invention relates to steam turbine blades and, more particularly, to side entry turbine blade roots.

Side entry turbine blade roots are typically formed with Christmas tree-shaped roots which fit into correspondingly shaped grooves in a rotor disk. The roots generally have three lugs on each side of a root centerline. Each lug has an inclined bearing surface which bears against a groove so that each blade root reacts against six bearing surfaces. When each blade is considered as a separate and distinct entity, the blade root surfaces and the groove bearing surfaces can be formed for satisfactory mating relationships and thus provide the desirable and required support for the blade.

It has become common practice to join individual blades into groups of blades by attachment to common platform and/or shroud portions. Such multiple blade units have higher rigidity and lower vibration susceptibility than single blades. In one form, a blade group may be constructed by attaching radially outer ends of several blades to a shroud after the blade roots are inserted into their respective rotor grooves. A disadvantage of coupling individual blades into groups is that circumferential displacement of the blades by the coupling tends to misalign the roots within the grooves. If the blade root centerline is not aligned with the groove centerline, the bearing surfaces may not seat properly causing stresses on the root structure to be unevenly distributed. In some instances, it has been found that some of the lugs lose contact with the groove surfaces so that only a portion of the lugs carry the blade stress. Such uneven loading can result in cracking and eventual failure of the root with potential blade separation during turbine operation.

In another form, blade groups may be constructed as integral units having a common shroud and a common platform. Such a blade group is illustrated in U.S. Pat. No. 4,130,379 to Partington and assigned to the assignee of the present invention. In this form, the blade roots may also be circumferentially displaced such that the blade root centerlines do not coincide with radius lines of the turbine rotor in which the blades are installed. This will result in similar shifting of the load bearing surfaces of the lugs on the blade root causing one or more lugs to carry more than their proportionate share of the blade loading and be subject to stress cracks and potential failure.

SUMMARY OF THE INVENTION

The above and other disadvantages of the prior art are overcome in a turbine blade characterized by a bilaterally symmetrical side entry blade root for attaching the turbine blade to a rotor of a steam turbine. The rotor has a longitudinal rotational axis of symmetry about which the blades are caused to rotate. Each blade has a foil portion and a platform interposed between the foil portions and the root, with the root being positionable in one of a plurality of complementary shaped grooves circumferentially disposed about the turbine rotor. The root includes at least one pair of lugs symmetrically arranged on opposite sides of the root with each of the lugs having an outer bearing surface for reacting against a complementary opposed mating surface formed in the associated rotor groove. The bearing surface on the lug is aligned along an arc of a circle centered on the rotor rotational axis.

The advantages of the above design is that a single pair of lugs insures contact with the mating surface within the rotor groove. Furthermore, the lugs can be made larger and more rugged with larger fillet radii. In the form in which a plurality of blades are connected together at the blade platforms to create an integral blade group, a single pair of lugs per root is entirely feasible since the connected blade platforms will resist the bending moments exerted on the blades. Furthermore, bending stresses on the blades and blade roots will be lower because of the high structural stiffness of the combination and the natural resonant frequencies will be higher so that partial admission stress will be reduced.

BRIEF DESCRIPTION OF THE DRAWINGS

For a better understanding of the present invention, reference may be had to the following detailed description taken in conjunction with the accompanying drawings in which.

DETAILED DESCRIPTION

Figure 1A:
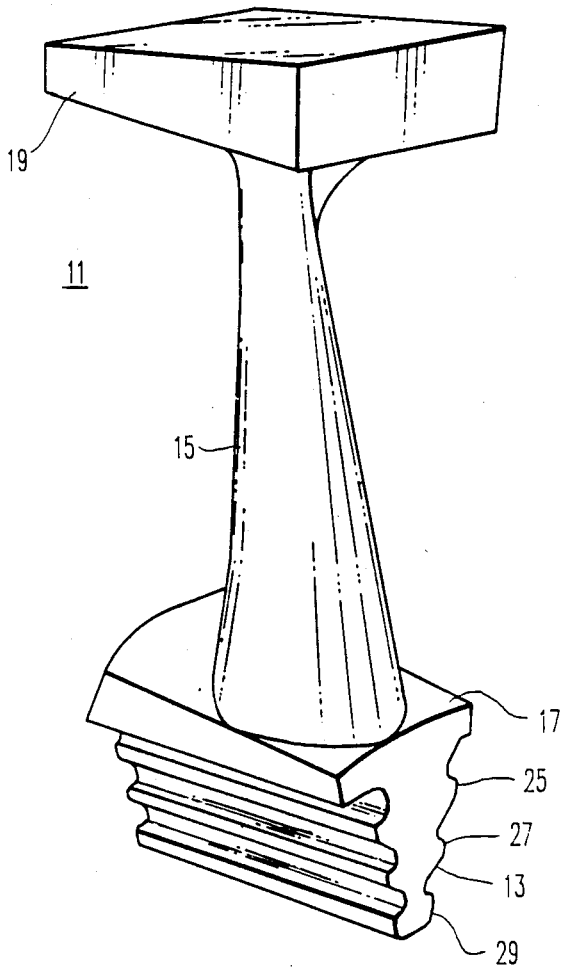
FIG. 1A (PRIOR ART)
FIGS. 1A and 1B illustrates a single side entry turbine blade and blade root for a steam turbine.
Figure 1B:
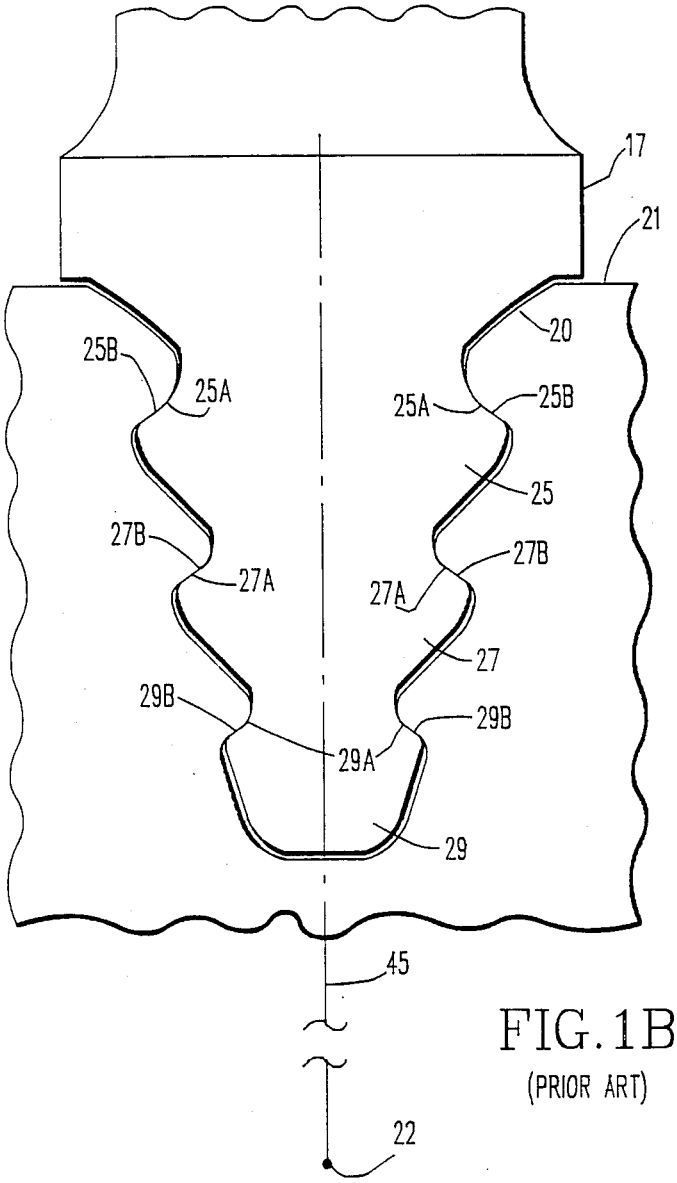
FIG. 1B (PRIOR ART)

FIGS. 1A and 1B illustrate a single side entry turbine blade 11 of the type used in steam turbines comprising a root 13, a foil 15 and a platform 17 interposed between the root 13 and the foil 15. The blade 11 also includes an integral shroud portion 19 which may be coupled to other shroud portions of adjacent blades to form a blade group. The blade 11 is secured against pseudo-static and dynamic forces by positioning the root 13 in a complementary shaped groove 20 on a turbine rotor 21 (see FIG. 2) having a longitudinal axis of rotation 22. The illustrated side entry turbine blade root includes an upper serrated portion or lug 25, a middle serrated portion or lug 27 and a lower serrated portion or lug 29 in order to withstand centrifugal loading and impart improved bending stiffness to the blade.

FIG. 1B illustrates clearly that the upper serrated portion 25 comprises two upper tangs or lugs arranged on opposite sides of the root 13 and positioned adjacent the blade platform 17. For purposes of illustration, the groove 20 formed in the rotor for accepting the blade root is shown as being slightly larger than the blade root so that a space appears between the edges of the groove and the edges of the blade. As can be seen, the stresses exerted on the blade root are supported at the upper lugs 25 by upper bearing surfaces 25A. The mating surfaces 25B in the groove react against the upper bearing surfaces 25A to counteract the centrifugal loading on the blade. Similarly, the lugs 27 have upper bearing sur faces 27A which react against mating or complementary groove surfaces 27B to distribute the stress caused by the centrifugal loading on the blade root. Additionally, the lower most lug 29 also includes upper bearing surfaces 29A which react against complementary groove loading surfaces 29B. Preferably, the blade is positioned precisely within the groove so that the forces on each side of the blade root and the stresses within the root are distributed uniformly between the three tiers or sets of lugs. It has been found, however, that when blades are joined together in integral blade groups, the circumferential stresses on the blades tend to shift the blade roots enough that the forces are no longer evenly distributed on both sides of the blade root and in some cases at least some of the lugs lose contact with the complementary mating loading surfaces within the groove structure. In these situations, the stresses tend to be concentrated on one or more lugs leading to potential cracks and failure of the blade root.

Figure 2:
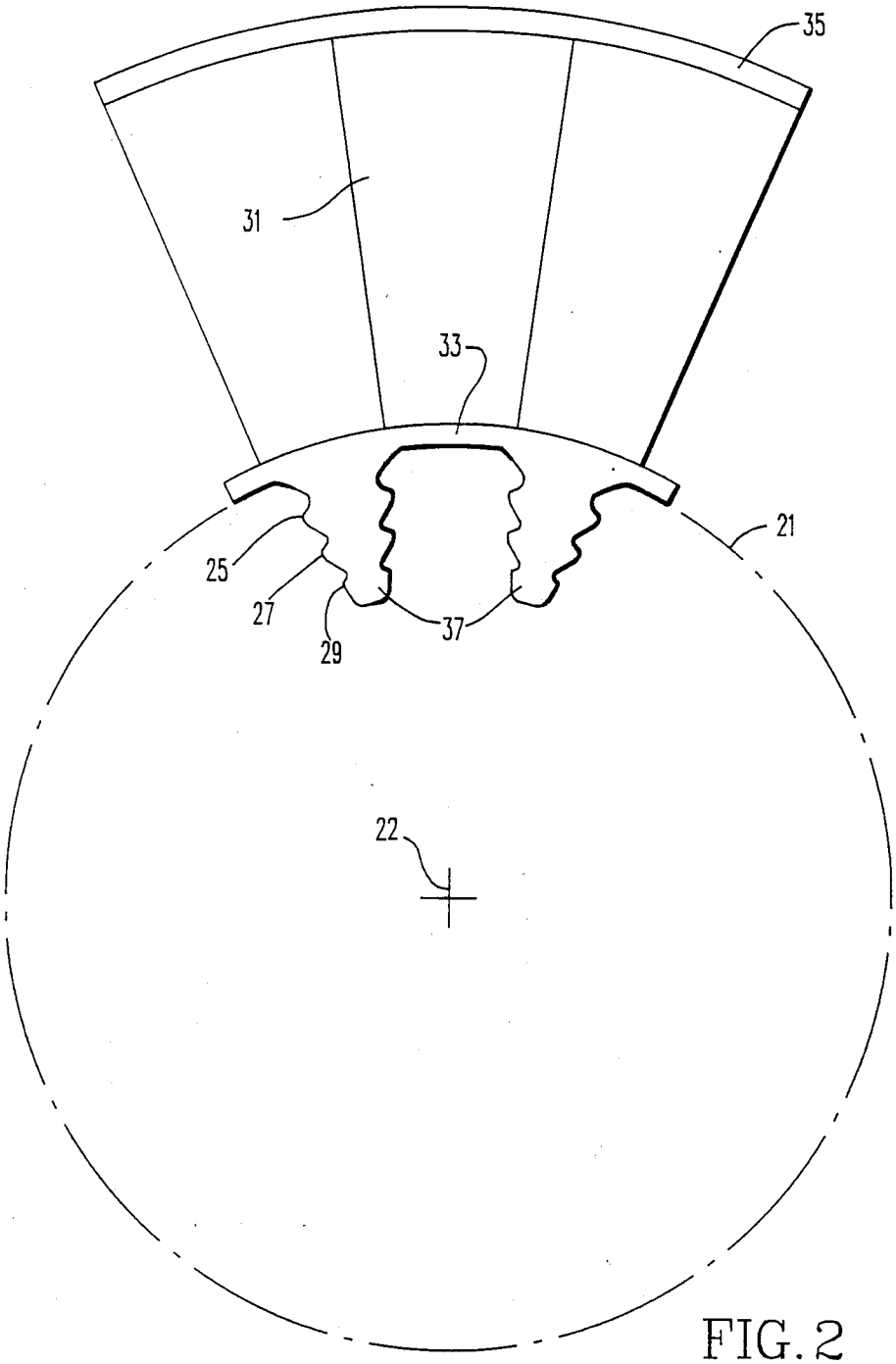
FIG. 2 (PRIOR ART)
FIG. 2 is an illustration of one form of integral side entry turbine blade group having a common shroud and common platform.

Turning now to FIG. 2, there is illustrated one form of integral side entry blade group in which three blades indicated generally at 31 are joined together on a common platform 33 and have an integral common shroud 35. Blade roots 37 extend from the blade platform 33 and support the blade group about the rotor 21. The blade root portions 37 are similar to the blade roots illustrated in FIGS. 1A and 1B. The particular blade group illustrated in FIG. 2 is an integral unit having a common platform with two spaced blade roots 37. It will be appreciated that single blades such as that shown in FIG. 1A could be joined together by well known means to form a blade group. However, it is general practice to form blade groups having a common shroud and common platform section.

The blade group illustrated in FIG. 2 is a side entry turbine blading group using side entry roots 37 which are substantially the same as the roots 13 of the blade of FIG. 1*a*. The lugs 25, 27 and 29 on the side of the blade roots 37 engage with and secure the blade unit into the rotor 21. While manufacturer of blades such as that shown in FIG. 1A having very precise root structures is a known technique, the process of manufacturing blade groups which have multiple blade roots that accurately distribute the forces exerted on the blade group over each of the lugs of the root has been difficult and as previously mentioned, have often resulted in insufficient support for the blade roots. In general, the problem arises from fewer than the total number of lugs on each of the blade root being in a position to absorb all of the force exerted on a blade group. The various forces exerted on a blade group are discussed in the aforementioned U.S. Pat. No. 4,130,379. For a discussion of the various vibrational and stress loading forces exerted on the roots of side entry blade groups, reference should be made to that patent.

Figure 3:
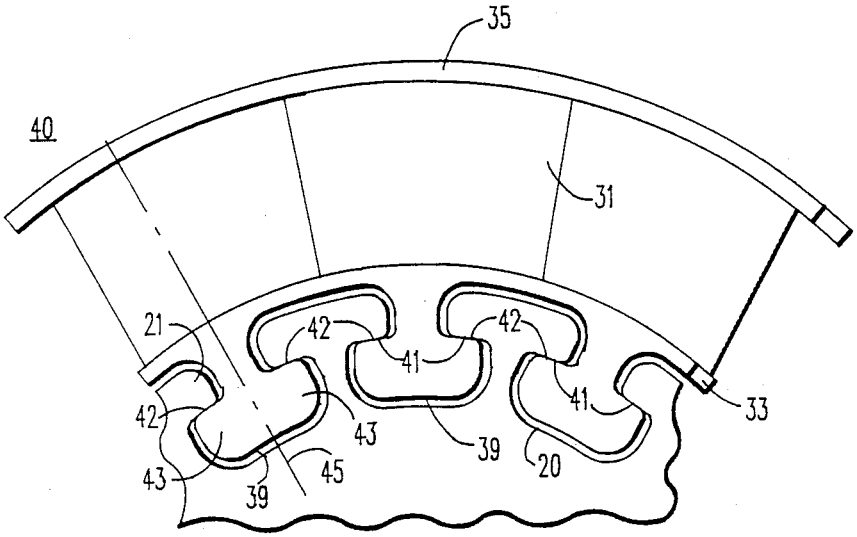
FIG. 3 illustrates a turbine blade root configuration for integral side entry turbine blade groups in accordance with the present invention.

The present invention is directed to a blade root for use with multiple side entry blade groups in which the blade roots of each member of the group are configured such that each blade root absorbs its designed centrifugal and vibrational stresses. Turning now to FIG. 3, there is shown one embodiment of a mulitple side entry blade group 40 in accordance with one form of the present invention in which each blade root 39 has a single pair of tangs or lugs 43 for supporting the mulitple blade group within the rotor 21. Each blade root 39 is provided with a larger and more rugged single pair of lugs 43 which assures definite contact with the rotor. As can be seen, this embodiment is significantly different from the Christmas-tree shaped design of blade roots such as those shown in FIGS. 1A and 1B. Because the root structure now has only a single pair of lugs per root, each lug 43 being on opposite sides of the depending root 39, the lugs can be made much heavier and can also have a larger fillet radius. In accordance with the present invention, each of the lugs 43 incorporate upper bearing surfaces 41 which lie on an arc of a circle centered on the axis 22 of rotor 21. In this arrangement, any circumferential shifting of the blade roots 39 will only result in the root structure shifting circumferentially but will not effect the bearing surfaces 41 reacting against the corresponding or mating surfaces 42 within the groove formed in the rotor 21. The lugs 43 will be forced to carry the entire load and will not shift that load to another set of lugs.

In the design illustrated in FIG. 3, each blade root 39 is characterized by being bilaterally symmetrical about an axis such as that illustrated at 45 passing through a center of the corresponding blade root and through the axis of rotation 22. Each blade root is fixed to the platform 33 interposed between the blade foil portions 31 and the blade roots. Each of the blad roots 39 is positionable in one of a plurality of complementary shaped grooves 20 circumferentially disposed about the turbine rotor 21. Each root 39 includes a pair of lugs 43 symmetrically arranged on opposite sides of the root centerline 45 with each of the lugs 43 having a radially outer bearing surface 41 for reacting against a complementary opposed mating surface 42 formed in the rotor grooves. The bearing surfaces 41 are aligned along an arc of a circle centered on the rotor rotational axis 22. Each of the blade groups includes a plurality of blades united into an integral blade unit 40 having a common shroud portion 35. In each instance, a plurality of spaced blade roots 39 extend from the blade platform 33 and each of the blade roots 39 is characterized by a single pair of opposed lugs 43 having bearing surfaces 41 lying on an arc of a circle centered on the rotor rotational axis 22. Similarly, the mating surfaces 42 are aligned on an arc of a circle centered on axis 22.

It will be appreciated that the disclosed improved blade root provides for more assured contact with each of the root bearing surfaces with complementary mating surfaces within a rotor groove. The lugs can be made large and more rugged than in prior designs and the blade platforms being connected together allows a single pair of lugs per root. Furthermore, the integral platform will resist bending moments. Bending stresses will be low because of high structural stiffness and the natural resonant frequencies of the blade group will be high. This will result in partial admission stress being greatly reduced and nozzle resonance can be avoided by tuning the blade groups in the same manner as has been done with other blade groups in the past.

While the invention has been described in what is presently considered to be a preferred embodiment, various modifications, variations and improvements will become apparent to those having ordinary skill in the art. Accordingly, it is intended that the invention not be limited to the disclosed embodiment but be interpreted within the spirit and scope of the appended claims.

I claim:

1. A turbine blade for attachment to a rotor, the rotor having a longitudinal rotational axis of symmetry, the blade having a foil portion and a platform interposed between the foil portion and the root, the blade root being characterized by a bilaterally symmetrical side entry blade root, the root being positionable in one of a plurality of complementary shaped grooves circumferentially disposed about the turbine rotor, the root including at least one pair of lugs symmetrically arranged on opposite sides of the root, each of the lugs having an outer bearing surface for reacting against a complementary opposed mating surface formed in the rotor grooves and the bearing surface being aligned along an arc of a circle centered on the rotor rotational axis.

2. The blade of claim 1 and including a plurality of blades united into an integral blade unit having a common shroud portion, a plurality of blade roots extending from the blade platform, each of the blade roots being characterized by a single pair of lugs having a bearing surface lying on an arc of a circle centered on the rotor rotational axis.

3. The blade of claim 2 wherein each of said plurality of blades is attached to a common platform portion.

4. An integral side entry control stage lade group for attachment to a rotor of a steam turbine, each group having an integral shroud, an integral platform and multiple roots, each root having a single pair of lugs and each lug having a bearing surface lying on an arc of a circle with center at an axis of the rotor.

5. A side entry blade for a steam turbine, the blade including a root portion characterized by a single pair of lugs with each of the pair of lugs being disposed on opposite sides of the root portion and having a bearing surface for supporting the blade, the bearing surface being aligned on an arc of a circle centered on an axis of the turbine.

* * * * *